US012263928B2

(12) United States Patent
Shere, Jr. et al.

(10) Patent No.: US 12,263,928 B2
(45) Date of Patent: Apr. 1, 2025

(54) TROLLING MOTOR STABILIZER

(71) Applicant: NAVICO, INC., Tulsa, OK (US)

(72) Inventors: Lonnie Shere, Jr., Claremore, OK (US); Christopher D. Crawford, Bixby, OK (US)

(73) Assignee: Navico, Inc., Tulsa, OK (US)

( * ) Notice: Subject to any disclaimer, the term of this patent is extended or adjusted under 35 U.S.C. 154(b) by 523 days.

(21) Appl. No.: 17/589,025

(22) Filed: Jan. 31, 2022

(65) Prior Publication Data

US 2023/0242228 A1 Aug. 3, 2023

(51) Int. Cl.

| | |
|---|---|
| ***B63H 20/02*** | (2006.01) |
| ***B63B 79/10*** | (2020.01) |
| ***B63B 79/40*** | (2020.01) |
| ***B63H 20/00*** | (2006.01) |

(52) U.S. Cl.

CPC ..... *B63H 20/02* (2013.01); *B63B 79/10* (2020.01); *B63B 79/40* (2020.01); *B63H 20/007* (2013.01)

(58) Field of Classification Search

CPC ..... B63H 20/02; B63H 20/007; B63H 20/08; B63B 79/10; B63B 79/40

See application file for complete search history.

(56) References Cited

U.S. PATENT DOCUMENTS 3,430,461 A * 3/1969 Boylan ..... A01D 34/736 403/260
6,431,923 B1 * 8/2002 Knight ..... B63H 25/42 440/6
7,887,381 B2 * 2/2011 Brass ..... B63H 5/125 440/6
8,888,065 B2 11/2014 Logan
9,296,455 B2 * 3/2016 Bernloehr ..... B63H 21/17
9,969,474 B1 * 5/2018 Truax ..... B63H 20/007
11,097,823 B1 * 8/2021 Boks ..... B63H 20/007

(Continued)

OTHER PUBLICATIONS

"Ram® Tough-Claw™ Trolling Motor Stabilizer;" *Ram Mounts*; retrieved Feb. 21, 2022 from https://www.rammount.com/part/RAP-400-202U.

(Continued)

*Primary Examiner* — Anthony D Wiest
(74) *Attorney, Agent, or Firm* — Nelson Mullins Riley & Scarborough LLP

(57) ABSTRACT

A system for locking a trolling motor assembly in a stowed position on a watercraft is provided herein. The system comprises a trolling motor assembly attached to the watercraft, wherein the trolling motor assembly is movable between the stowed position and a deployed position. The system further includes a locking mechanism mounted to the watercraft and configured to interact with the trolling motor assembly when the trolling motor assembly is in the stowed position. The locking mechanism defines a locked state and an unlocked state and is configured to transition between the states. The system additionally includes a controller having a memory including program code configured to, when executed, cause a processor to determine an instance in which to transition the locking mechanism from the locked state to the unlocked state and, in response, cause the locking mechanism to transition from the locked state to the unlocked state.

21 Claims, 9 Drawing Sheets

(56) References Cited

U.S. PATENT DOCUMENTS

| | | | | |
|---|---|---|---|---|
| 11,148,685 | B2 * | 10/2021 | Stojc | B61D 19/023 |
| 2007/0232159 | A1 * | 10/2007 | Lee | B63H 20/007 440/63 |

OTHER PUBLICATIONS

"Troll-Tamer™ for Minn Kota Trolling Motor Stabilizer Lock;" *T-H Marine Supplies*; retrieved Mar. 15, 2022 from https://thmarinesupplies.com/products/troll-tamer-trolling-motor-stabilizer-lock.

* cited by examiner

TROLLING MOTOR STABILIZER

FIELD OF THE INVENTION

Embodiments of the present invention relate generally to trolling motors, and more particularly, to systems for stabilizing a stowed trolling motor.

BACKGROUND OF THE INVENTION

Trolling motor assemblies are often used during fishing or other marine activities. The trolling motor assembly attaches to the watercraft and propels the watercraft along a body of water. While trolling motor assemblies may be utilized as the main propulsion system of watercraft, trolling motor assemblies are often utilized to provide secondary propulsion or precision maneuvering that can be ideal for fishing activities. As the trolling motor may not be in use at all times it is beneficial to easily maneuver the trolling motor assembly between a deployed position and a stowed position. Applicant has developed systems, assemblies and methods detailed herein to improve the stabilization of a trolling motor assembly in the stowed position on a watercraft.

BRIEF SUMMARY OF THE INVENTION

Some trolling motors are maneuverable from a stowed position to a deployed position, and vice versa. In some situations, a user may position the trolling motor in the stowed position when utilizing a primary propulsion motor, or when transporting the watercraft by land (e.g., on a watercraft trailer). When the watercraft is moving the trolling motor may bounce or move due to the external forces on the watercraft (e.g., waves, wind, etc.). A trolling motor stabilizer may be utilized to reduce the bounce, however, many stabilizers require manual intervention to lock and unlock the stowing mechanism. Thus, some embodiments of the present invention provide an automated securing system to retain a trolling motor in the stowed position, and easily transition between the deployed position and the stowed position upon the occurrence of an event.

Applicant has developed various example systems and methods, as detailed herein to stabilize a trolling motor of a watercraft in the stowed position, while providing a reliable release mechanism to aid in the transition between the stowed position and the deployed position of the trolling motor. Notably, while the present disclosure provides the specific example of stabilizing trolling motors, such systems could be used with any marine device that is stowed and deployed, such as a sonar pole, an anchor pole, an anchor system, etc.

In some embodiments, a system for locking a trolling motor assembly in a stowed position on a watercraft is provided. The system comprises the trolling motor assembly attached to the watercraft. The trolling motor assembly is movable between the stowed position and a deployed position. The trolling motor assembly comprises a shaft extending along a central axis from a first end to a second end, a trolling motor at least partially contained within a trolling motor lower unit. The trolling motor lower unit is attached to the second end of the shaft, When the trolling motor assembly is attached to the watercraft and the trolling motor lower unit is submerged in a body of water. The trolling motor, when operating, is configured to propel the watercraft to travel along the body of water. The system further comprises a locking mechanism mounted to the watercraft and configured to interact with the trolling motor assembly when the trolling motor assembly is in the stowed position. The locking mechanism defines a locked state and an unlocked state. When the trolling motor is in the stowed position and the locking mechanism is in the locked state, the locking mechanism prevents movement of the trolling motor assembly from the stowed position, while, when the trolling motor is in the stowed position and the locking mechanism is in the unlocked state, the trolling motor assembly may move from the stowed position. The system further includes a controller comprising a processor, a memory including program code configured to, when executed, cause the processor to determine an instance in which to transition the locking mechanism from the locked state to the unlocked state and, in response, cause the locking mechanism to transition from the locked state to the unlocked state.

In some embodiments, the locking mechanism may include an electromagnet configured to be activated to form a magnetic force that, when interacting with the trolling motor assembly, holds the trolling motor assembly in the stowed position to prevent movement of the trolling motor assembly such that the locking mechanism is in the locked state. The electromagnet may be further configured to be deactivated to cease forming the magnetic force such that the locking mechanism is in the unlocked state.

In some embodiments, the locking mechanism may comprise a connection feature attached to the trolling motor assembly and movable with the trolling motor assembly. When in the locked state, the electromagnet may apply the magnetic force to the connection feature.

In some embodiments, the connection feature of the locking mechanism may be attached to the shaft of the trolling motor assembly. In some embodiments, the magnetic force may be applied to the shaft of the trolling motor assembly. In some embodiments, the locking mechanism may comprise an actuator configured to be activated to mechanically move to transition the locking mechanism to the locked state or deactivated to mechanically move to transition the locking mechanism to the unlocked state. In some embodiments, the locking mechanism may be biased to the locked state.

In some embodiments, the program code may be further configured to, when executed, cause the processor to determine an instance in which to transition the locking mechanism from the unlocked state to the locked state and, in response, cause the locking mechanism to transition from the unlocked state to the locked state.

In some embodiments, the system may further comprise a stowage sensor configured to determine when the trolling motor assembly has entered the stowed position. The program code may be further configured to, when executed, cause the processor to determine an instance in which to transition the locking mechanism from the unlocked state to the locked state based on sensor data from the stowage sensor. In some embodiments, the program code may be further configured to, when executed, cause the processor to determine an instance in which to transition the locking mechanism from the unlocked state to the locked state based on a speed of the watercraft being above a threshold speed. In some embodiments, the threshold speed may be 5 miles per hour.

In some embodiments, the program code may be further configured to, when executed, cause the processor to determine an instance in which to transition the locking mechanism from the locked state to the unlocked state based on a speed of the watercraft being below a threshold speed. In some embodiments, the threshold speed may be 5 miles per hour.

In some embodiments, the system may further comprise a stow and deploy system for the trolling motor assembly, wherein the stow and deploy system is configured to transition the trolling motor assembly between the stowed position and the deployed position in an automated manner. The program code may be further configured to, when executed, cause the processor to determine an instance in which to transition the locking mechanism from the locked state to the unlocked state as part of an automated deployment protocol to transition the trolling motor assembly to the deployed position.

In some embodiments, the program code may be further configured to, when executed, cause the processor to determine an instance in which to transition the locking mechanism from the unlocked state to the locked state as part of an automated stowage protocol to transition the trolling motor assembly to the stowed position and, in response, cause the locking mechanism to transition from the unlocked state to the locked state.

In some embodiments, the controller may be housed in a housing of the trolling motor assembly. In some embodiments, the controller may be housed in a marine electronics device separate from the trolling motor assembly and the locking mechanism. In some embodiments, the controller may be housed in a housing that is attached to or includes at least a portion of the locking mechanism.

In another example embodiment, a locking mechanism for locking a trolling motor assembly in a stowed position on a watercraft is provided. The locking mechanism comprises a base mounted to the watercraft and configured to interact with the trolling motor assembly when the trolling motor assembly is in the stowed position. The locking mechanism defines a locked state and an unlocked state. When the trolling motor is in the stowed position and the locking mechanism is in the locked state. The locking mechanism prevents movement of the trolling motor assembly from the stowed position. When the trolling motor is in the stowed position and the locking mechanism is in the unlocked state, the trolling motor assembly is able to move from the stowed position. The locking mechanism further comprises a controller. The controller comprises a processor, and a memory including program code configured to, when executed, cause the processor to determine an instance in which to transition the locking mechanism from the locked state to the unlocked state and, in response, cause the locking mechanism to transition from the locked state to the unlocked state.

In yet another embodiment, a method for locking a trolling motor assembly in a stowed position on a watercraft is provided. The method comprises providing a trolling motor assembly attached to a watercraft. The trolling motor assembly movable between the stowed position and a deployed position. The trolling motor assembly comprises a shaft extending along a central axis from a first end to a second end, and a trolling motor at least partially contained within a trolling motor lower unit. The trolling motor lower unit is attached to the second end of the shaft. When the trolling motor assembly is attached to the watercraft and the trolling motor lower unit is submerged in a body of water, the trolling motor, when operating, is configured to propel the watercraft to travel along the body of water. The method continues by providing a locking mechanism mounted to the watercraft configured to interact with the trolling motor assembly when the trolling motor assembly is in the stowed position. The locking mechanism defines a locked state and an unlocked state. When the trolling motor is in the stowed position and the locking mechanism is in the locked state, the locking mechanism prevents movement of the trolling motor assembly from the stowed position. When the trolling motor is in the stowed position and the locking mechanism is in the unlocked state, the trolling motor assembly is able to move from the stowed position. The method continues by determining, via a controller, an instance in which to transition the locking mechanism from the locked state to the unlocked state; and causing, in response thereto, the locking mechanism to transition from the locked state to the unlocked state.

In yet another example embodiment, a locking mechanism for locking a trolling motor assembly in a stowed position on a watercraft is provided. The locking mechanism comprises a base mounted to the watercraft and configured to interact with the trolling motor assembly when the trolling motor assembly is in the stowed position. The locking mechanism defines a locked state and an unlocked state. When the trolling motor is in the stowed position and the locking mechanism is in the locked state, the locking mechanism prevents movement of the trolling motor assembly from the stowed position, while, when the trolling motor is in the stowed position and the locking mechanism is in the unlocked state, the trolling motor assembly is able to move from the stowed position. The base further includes an electromagnet. The locking mechanism may further include a power source in electrical communication with the electromagnet, an interference button in electrical communication with the power source. The interference button configured to interrupt the electrical communication between the power source and the electromagnet.

BRIEF DESCRIPTION OF THE DRAWINGS

Figure 1:
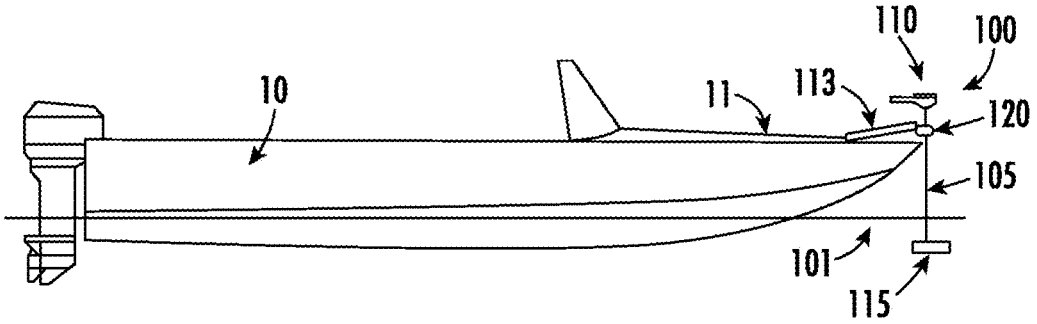
Figure 2:
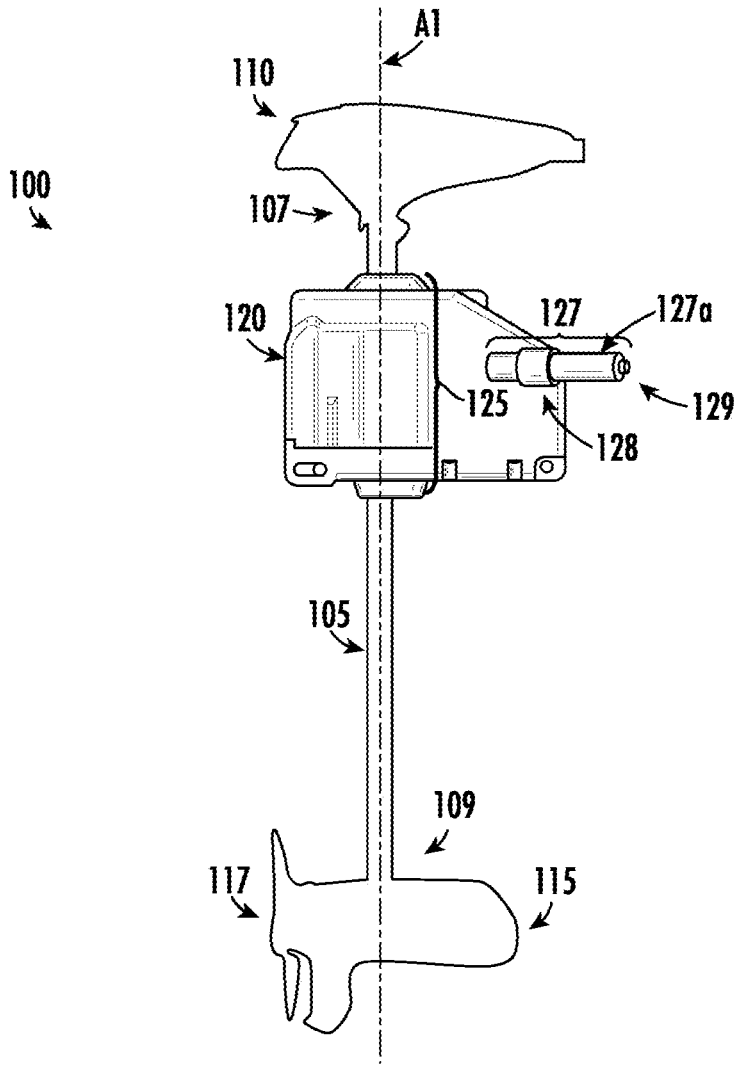
Figure 3:
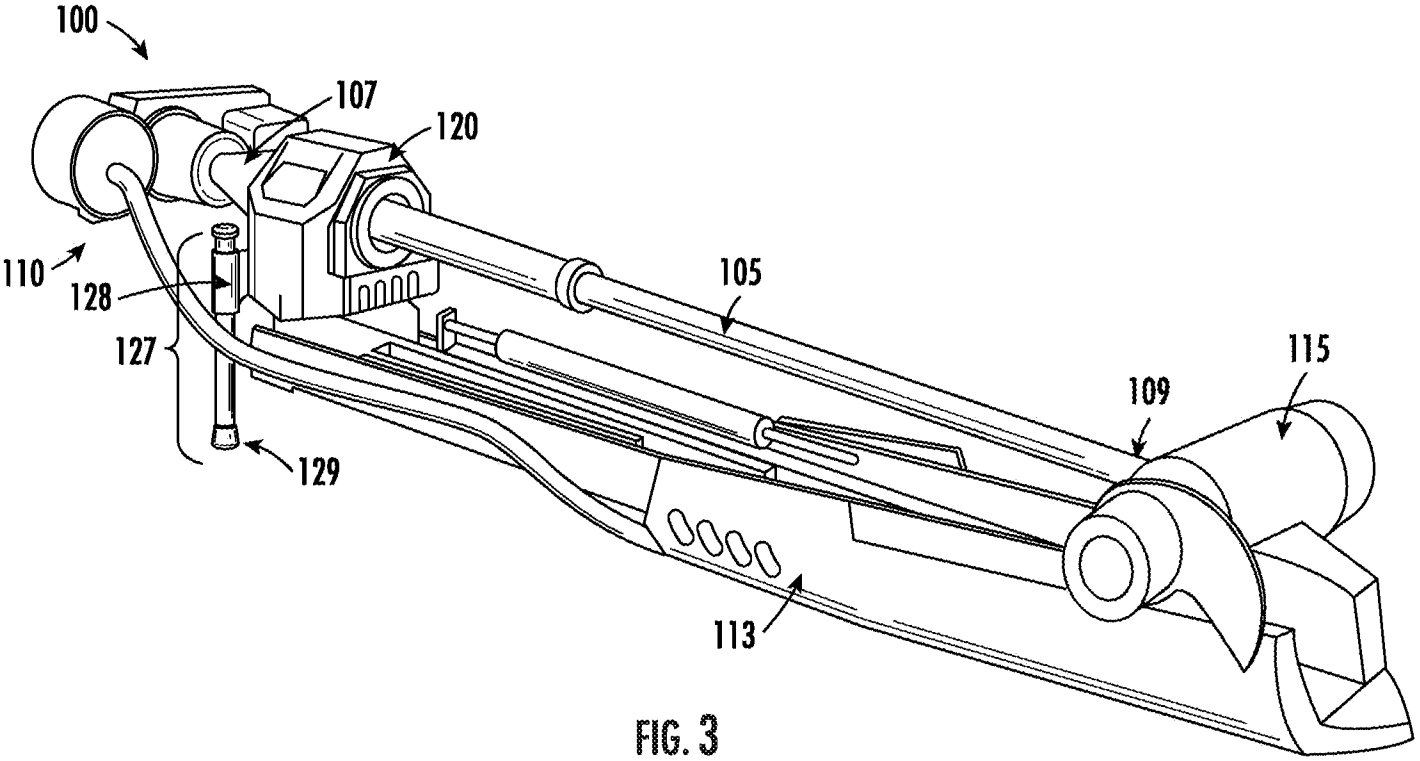
Figure 4:
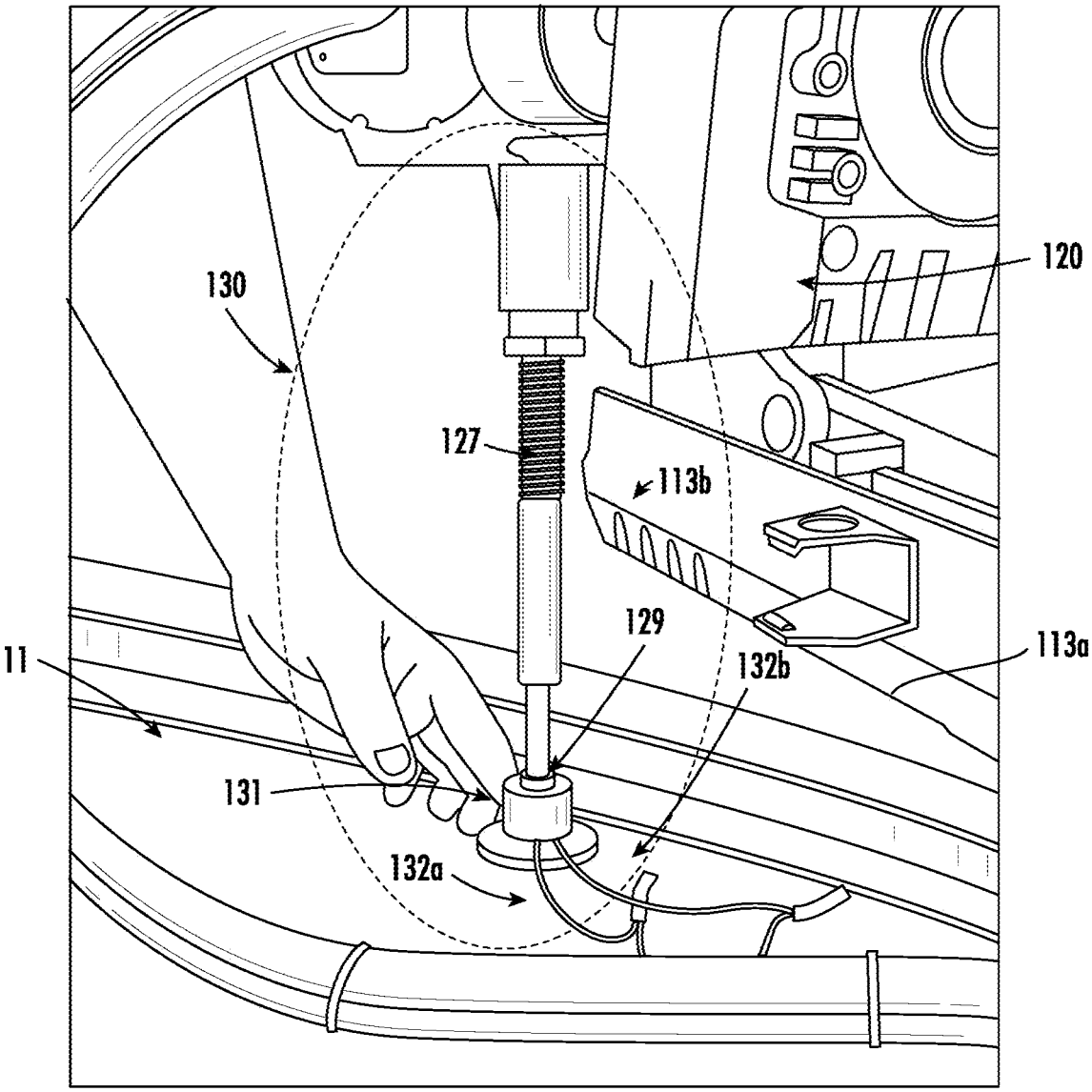
Figure 5:
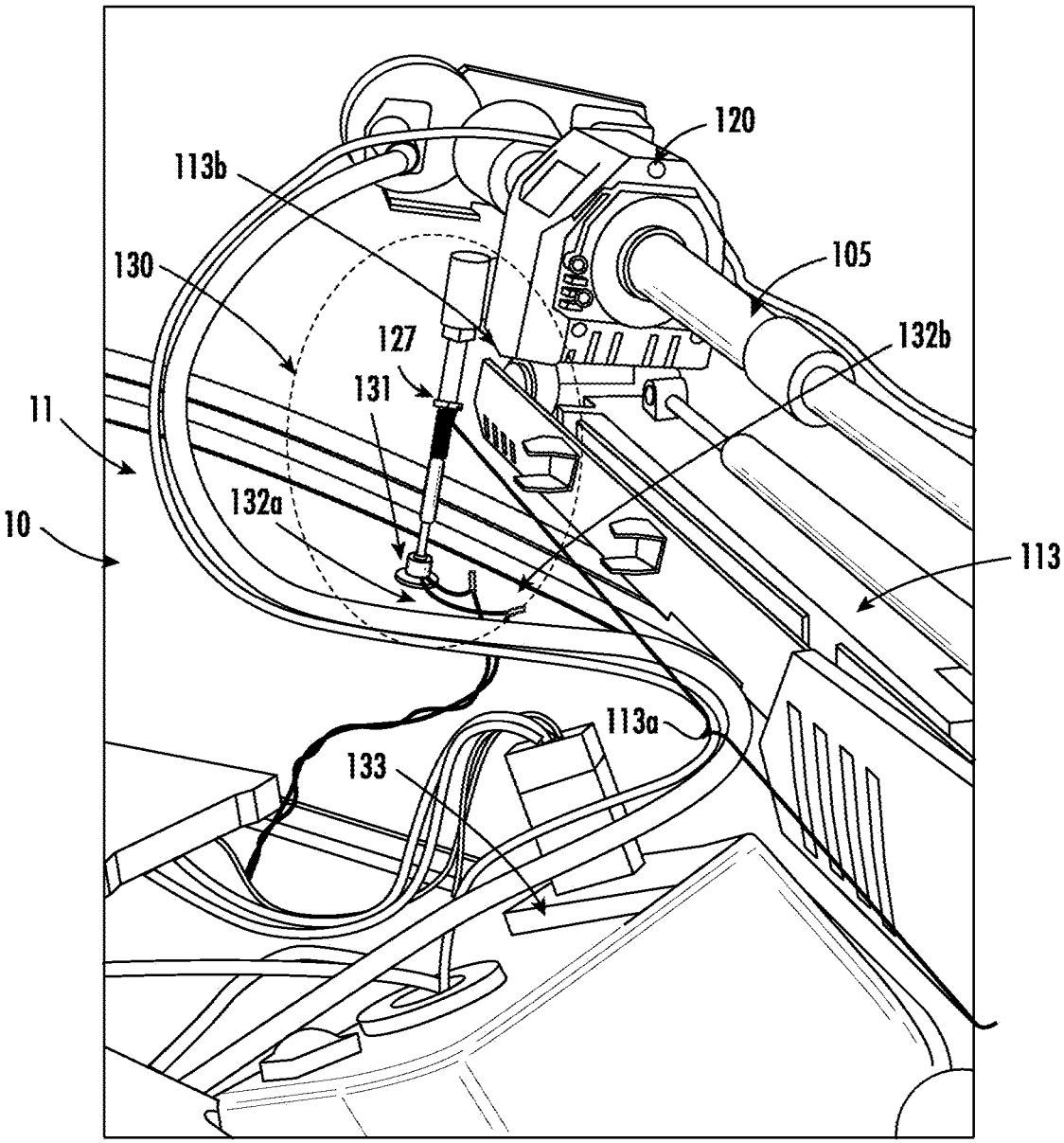
Figure 6:
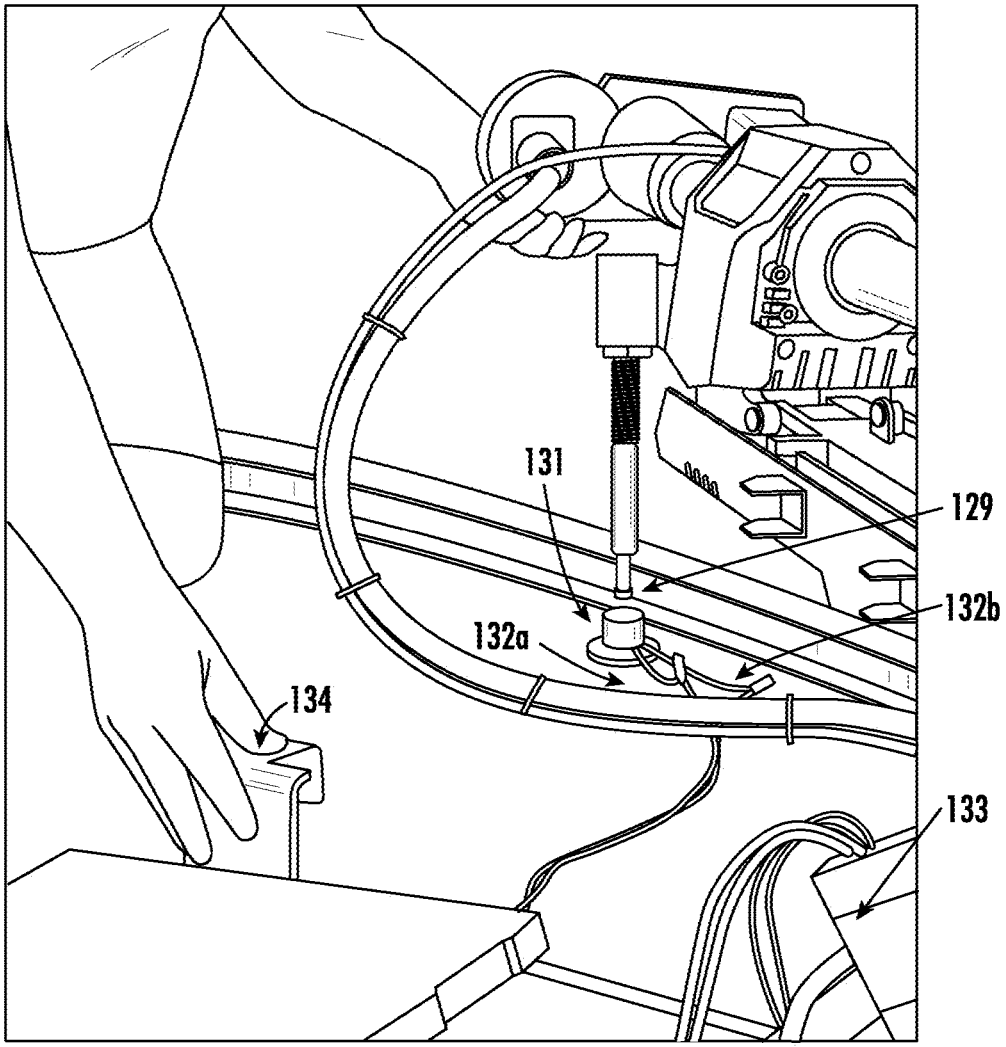
Figure 7:
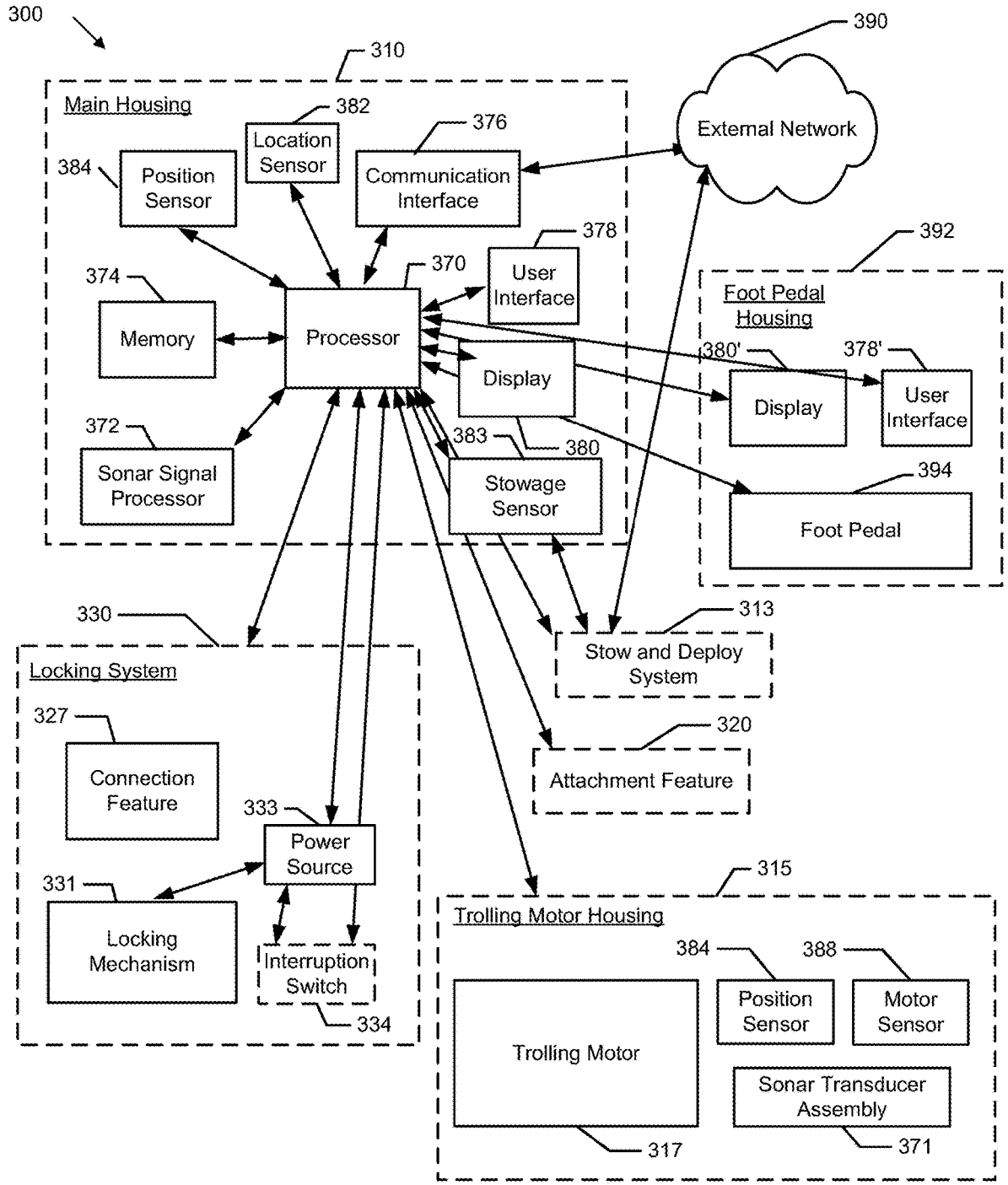
Figure 8:
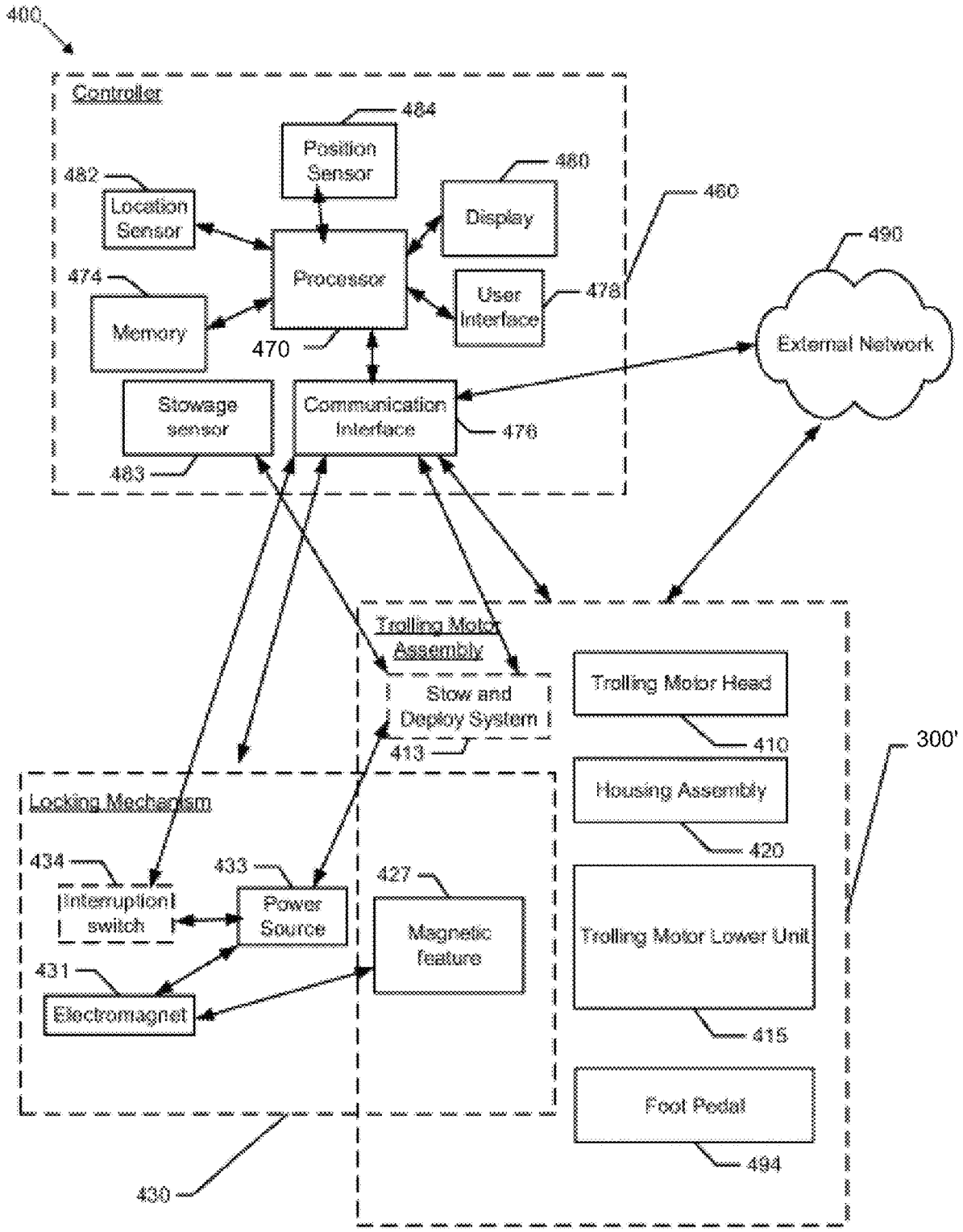
Figure 9:
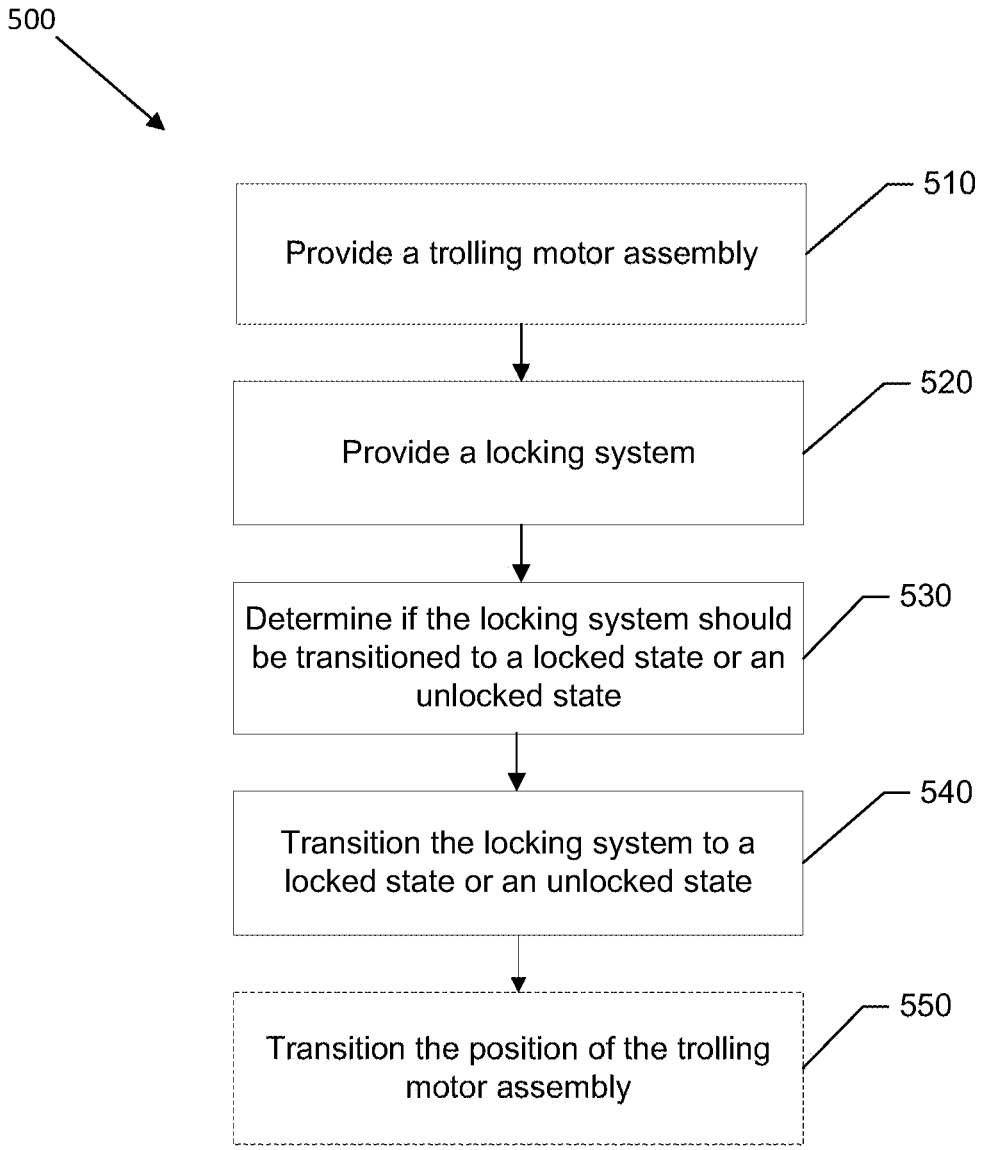

Having thus described the invention in general terms, reference will now be made to the accompanying drawings, which are not necessarily drawn to scale, and wherein:

FIG. 1 illustrates an example trolling motor assembly attached to a front of a watercraft, in accordance with some embodiments discussed herein;

FIG. 2 illustrates an example trolling motor assembly in a deployed position, in accordance with some embodiments discussed herein;

FIG. 3 illustrates the example trolling motor assembly in the stowed position, in accordance with some embodiments discussed herein;

FIG. 4 illustrates a perspective view of an example locking mechanism attached to a floor of a watercraft, with a trolling motor assembly in the stowed position, in accordance with some embodiments discussed herein;

FIG. 5 illustrates a perspective view of the locking mechanism shown in FIG. 4 in a locked state, in accordance with some embodiments discussed herein;

FIG. 6 illustrates a perspective view of the locking mechanism shown in FIG. 4 in an unlocked state, in accordance with some embodiments discussed herein;

FIG. 7 shows a block diagram illustrating an example system including a locking mechanism for a trolling motor assembly, in accordance with some embodiments discussed herein;

FIG. 8 shows a block diagram illustrating another example system including a locking mechanism for a trolling motor assembly, where a controller is located remotely from the locking system and the trolling motor assembly, in accordance with some embodiments discussed herein; and FIG. 9 illustrates a flowchart of an example method for operating a locking mechanism, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Like reference numerals refer to like elements throughout.

Some embodiments of the present invention provide for stabilization mechanisms for marine devices that are deployable and stowable relative to a watercraft, such as trolling motor assemblies. FIG. 1 illustrates an example watercraft 10 on a body of water 101. The watercraft 10 has a trolling motor assembly 100 illustrated in a deployed position attached to the front of the watercraft 10 by a trolling motor mount 113. In some embodiments, the trolling motor mount 113 may be attached to a deck 11 of the watercraft 10. The trolling motor assembly 100 may be positioned on the watercraft 10 such that a trolling motor lower unit 115 is submerged in the body of water 101. A trolling motor 117, see FIG. 2, may be partially within the trolling motor lower unit 115, and may be, for example, gas-powered or electric. The trolling motor may be used as a propulsion system to provide thrust so as to cause the watercraft 10 to travel along the surface of the water 101. The trolling motor assembly 100 may also include a trolling motor head 110 positioned out of the water and on a first end of a shaft 105. While the depicted embodiment shows the trolling motor assembly 100 attached to the front of the watercraft 10 and as a secondary propulsion system, example embodiments described herein contemplate that the trolling motor assembly 100 may be attached in any position on the watercraft 10 and/or may serve as the primary propulsion system for the watercraft 10.

In accordance with various aspects of the present teachings, the trolling motor assembly 100 depicted in the example embodiment of FIG. 1 may include an housing assembly 120 secured about a shaft 105. In some embodiments, as illustrated in FIG. 2, the housing assembly 120 may be a system housing having a steering system for changing the angular orientation of the trolling motor 100 so as to change the direction of the trolling motor's thrust when the propeller is operating, thereby steering the watercraft 10. Notably, the system housing may include a trim system for changing the vertical position of the trolling motor lower unit 115 (e.g., by causing the trolling motor shaft 105 to raise or lower) as disclosed within U.S. patent application Ser. No. 17/490,144, entitled "Combined Trim and Steering Trolling Motor System", filed Sep. 30, 2021, which is assigned to the Assignee and Applicant of this application, and which is incorporated by reference herein in its entirety.

Depending on the design, a trolling motor may be gas-powered or electric. Moreover, steering may be accomplished, via foot control, or even through use of a remote control. Additionally, in some cases, an autopilot may operate the trolling motor autonomously.

FIG. 2 illustrates an example trolling motor assembly 100. The trolling motor assembly 100 may include a shaft 105 having a first end 107 and a second end 109 defining a central axis A1 extending therebetween. The trolling motor assembly 100 may include a trolling motor head 110 attached to the first end 107 of the shaft 105, and a trolling motor lower unit 115 attached to the second end 109 of the shaft 105. In some embodiments, when the trolling motor assembly 100 is attached to the watercraft 10 and the trolling motor, or trolling motor lower unit 115 is submerged in the water, the trolling motor is configured to propel the watercraft to travel along the body of water. In addition to containing the trolling motor, the trolling motor lower unit 115 may include other components described herein including, for example, a sonar transducer assembly and/or other sensors.

The trolling motor head 110 is positioned outside of the water and is connected to the shaft 105 proximate the first end 107 of the shaft 105. The trolling motor head 110 may be configured to house components of the trolling motor assembly, such as may be used for processing marine or sensor data and/or controlling operation of the trolling motor among other things. For example, with reference to FIG. 7, depending on the configuration and features of the trolling motor assembly, the trolling motor head 110 may contain, for example, one or more processors 370, memory 374, location sensor(s) 382, stowage sensor(s) 383, position sensor(s) 384, communication interface(s) 376, user interface(s) 378, and/or display(s) 380.

The trolling motor assembly 100 may further include an housing assembly 120. The housing assembly 120 is configured to interact with the trolling motor assembly 100 and the watercraft 10, such as via the trolling motor mount 113. In some embodiments, the housing assembly is the system housing. The housing assembly may be moveably fixed about the shaft 105 via a trolling motor shaft attachment feature 125. In some embodiments, components of the housing assembly 120 may be configured to rotate the shaft 105 about the central axis A1, and to move the shaft 105 vertically along the central axis A1 and through the shaft attachment feature 125.

The housing assembly 120 may connect to the trolling motor mount 113 to enable attachment to the watercraft 10. In some embodiments, the trolling motor mount 113 may allow for complete removal of the trolling motor assembly 100 from the watercraft 10 and/or for movement about an edge of the watercraft 10 such that the trolling motor mount 113 may maneuver the trolling motor assembly 100 to remove the trolling motor lower unit 115 from the water (e.g., transition from the deployed position to the stowed position).

In some embodiments, a connection feature 127 may be attached to or formed integral to the trolling motor assembly 100. In some embodiments, the connection feature 127 may define a body 127*a* that may extend, for example, perpendicular to the shaft 105. In some embodiments, the connection feature 127 may be formed within the trolling motor head 110, the trolling motor mount 113, and/or the housing assembly 120, while in some embodiments, the connection feature 127 may be attached to the trolling motor assembly 100 by a coupling device 128.

In some embodiments, the coupling device 128 may be configured to retain the connection feature 127 such that a portion of the body 127*a* is moveable through the coupling device 128. In some embodiments, the coupling device 128 is rotatably fixed to trolling motor assembly 100 such that a user may manually rotate the connection feature 127 (e.g., from a horizontal position to a vertical position). In some embodiments, the housing assembly 120 may be configured to rotate the coupling device 128 automatically, such as a part of an automated stowage protocol. In some embodiments, the connection feature 127 is magnetized along the entire body 127*a*, and in other embodiments, the connection feature 127 includes a magnetic surface 129. In some embodiments the magnetic surface 129 may be steel, iron, nickel, cobalt and/or any other magnetic material. In some embodiments, the magnetic surface 129 may be a thin disc, while in other embodiments the magnetic surface may be an extended body, from the connection feature 127.

In some embodiments, the connection feature 127 may be configured as a collar surrounding a portion of the shaft 105, and in other embodiments the shaft 105 may be, at least, composed from a magnetic material.

FIG. 3 illustrates a perspective view of the trolling motor assembly 100 in the stowed position (e.g., when the trolling motor assembly is removed from the body of water and resting within or on the watercraft 10). In the stowed position, the trolling motor assembly 100 may be oriented such that the shaft 105 may be generally horizontal, or parallel to the deck 11 of the watercraft 10. In some embodiments, the trolling motor mount 113 is configured to transition between a stowed state and a deployed state, such as described in U.S. Pat. No. 10,953,972, entitled "Trolling Motor Assembly with Deployment Assistance", which is assigned to the Applicant and Assignee of the present application and incorporated by reference herein in its entirety.

In some embodiments, the trolling motor mount 113 may be configured to transition the trolling motor assembly 100 between the stowed position and the deployed position in an automated manner. In some embodiments, the trolling motor mount 113 may be configured to receive an automated deployment protocol, and in response, cause a transition to the deployed position, such as from the stowed position. Similarly, the trolling motor mount 113 may receive an automated stowage protocol, and, in response, cause the transition to the stowed position, such as from the deployed position.

As illustrated in FIG. 3, the connection feature 127 is positioned on the system housing 120, in other embodiments, the connection feature 127 may be positioned on the trolling motor mount 113. In some embodiments, the shaft 105 may be formed from a magnetic material, or have a magnetic material wrapped about a portion of the shaft 105 wherein the wrapped portion of the shaft 105 is the connection feature 127.

A trolling motor assembly may be stabilized in the stowed position by a locking mechanism. FIG. 4 illustrates a perspective view of a trolling motor assembly 100 in the stowed position on a watercraft 10, stabilized by a locking mechanism 130. In some embodiments, the locking mechanism 130 includes an electromagnet 131 mounted to the watercraft 10 and configured to interact with the connection feature 127. In some embodiments, the electromagnet 131 may be integrated into the deck 11, or another fixture within the watercraft 10. The electromagnet 131 may be positioned along an internal edge 113*a* of the trolling motor mount 113, and, in some embodiments, may be positioned along a distal edge 113*b* of the trolling motor mount 113. In some embodiments, the distal edge 113*b* is positioned proximate the trolling motor head 110 when in the stowed position.

In some embodiments, the electromagnet 131 may be in electrical communication with a power source 133, see FIG. 5. In some embodiments, the power source 133 may be integral to the watercraft 10, for example, the power source 133 may be located within the helm of the watercraft 10 or may be a battery positioned elsewhere on the watercraft. The electromagnet 131 may be connected to the power source 133 by a first wire 132*a* and/or a second wire 132*b*. In some embodiments, the wires 132*a*, 132*b* are configured to supply power to induce a current across the electromagnet 131 thereby generating a magnetic field.

In some embodiments, the electromagnet 131 may generate sufficient force to secure the trolling motor assembly to the deck 11 of the watercraft. In some embodiments, the electromagnet 131 may generate up to 100 pounds of holding force, at least 125 pounds of holding force, or at least 150 pounds of holding force. In some embodiments, the electromagnet may be up to 12V, at least 24V, or at least 36V. In some embodiments, the power source 133 may provide between 50 and 350 mA of power, between 100-300 mA of power, or even 150-250 mA of power.

The locking mechanism 130 may define a locked state. In the locked state, the locking mechanism is configured to hold the trolling motor assembly in the stowed position to prevent movement of the trolling motor assembly. For example, in the locked state, the electromagnet 131 and the connection feature 127 are engaged and the magnetic force generated by the current across the electromagnet 131 prevents the connection feature 127 from disengaging. In some embodiments, the locked state refers only to the type of magnetic force generated by the electromagnet 131. In some embodiments, the locking mechanism is in the locked state when there is a magnetic field generated, such that the magnetic field attracts the connection feature 127.

In some embodiments, when the trolling motor assembly 100 is in the stowed position, the electromagnet 131 is in the locked state thereby stabilizing the trolling motor. In some embodiments, the locking mechanism 130 prevents incidental movement (e.g., bouncing, rattling, and/or vibrations) of the trolling motor assembly 100 while the watercraft is moving. In some embodiments, the locking mechanism 130 prevents the trolling motor assembly 100 from transitioning or moving from the stowed position without an interventive force, command or movement.

In some embodiments, the locking mechanism 130 may be configured to provide a constant voltage to the electromagnet 131, thereby biasing the electromagnet 131 to the locked state. In some embodiments, the electromagnet 131 is regulated by an actuator.

The locking mechanism 130 may define an unlocked state. In the unlocked state the electromagnet 131 and the connection feature 127 are disengageable. The unlocked state may be when the electromagnet 131 ceases to generate a magnetic force. In some embodiments, the unlocked state may include when the electromagnet generates a magnetic force that repels the connection feature 127, thereby disengaging the locking mechanism 130.

As discussed herein the locking mechanism 130 may be configured to transition between the locked state and the unlocked state as illustrated in FIGS. 5-6. In some embodiments, the locking mechanism 130 may be in electrical communication with an internal network, for example, the NMEA2000 (N2K) network, an external network, and/or a user input device. The locking mechanism 130 may be configured to receive commands and/or indications from a network or user input device.

As illustrated in FIG. 5, the locking system 130 is in the locked state, wherein the connection feature 127 is engaged with the electromagnet 131. In some embodiments, the locking mechanism 130 is configured receive an indication to transition from the locked state to the unlocked state and thereby cause the transition between the locked state and the unlocked state. In some embodiments, the transition to the unlocked state, illustrated in FIG. 6, allows the trolling motor mount 113 to transition from the stowed position, such as to the deployed position.

In some embodiments, the locking mechanism 130 is in communication with a stowage sensor 383, see FIG. 7. The stowage sensor 383 may be configured to determine the position of the trolling motor mount (e.g., stowed position, deployed position, an intermediate position, etc.) and transition the locking mechanism 130 accordingly. For example, the stowage sensor may determine the trolling motor assembly 100 entered the stowed position, and the locking mechanism 130 may transition to the locked state to retain the trolling motor assembly 100 in the stowed position.

In some embodiments, the stowage sensor may determine that the trolling motor assembly 130 began the transition between the deployed position and the stowed position, and the locking mechanism 130 may begin to transition to the locked state (e.g., supply power to the electromagnet 131).

In some embodiments, as illustrated in FIG. 6, the locking mechanism 130 may transition between the locked state and the unlocked state by a user engaging an interference button 134. In some embodiments, the interference button 134 is configured to cease the power supply to the electromagnet 131. In some embodiments, the interference button 134 is configured to reverse the magnetic field of the electromagnet 131 such that the electromagnet releases and repels the connection feature 127. In some embodiments, the interference button 134 is a manual button within the deck 11. In some embodiments, the interference button may be within a user interface device in electrical communication with the locking mechanism 130.

As discussed above, in some embodiments, the locking mechanism 130 may be in electrical communication with a controller, for example, an external network, an internal network, or a user input device. In some embodiments, the controller may be configured to determine instances to transition the locking mechanism 130 between the locked state and the unlocked state.

In some embodiments, the controller may determine a threshold speed to transition between the locked state and the unlocked state. The threshold speed may be programmed into the controller and may be monitored by one or more sensors (e.g., a position sensor 384, and/or a location sensor 382). In some embodiments, the threshold speed may be 5 miles per hour, 10 miles an hour or 15 miles per hour. In some embodiments, the controller may determine the trolling motor assembly 100 is in the stowed position and the watercraft 10 is traveling above the threshold speed. The controller may cause the locking mechanism 130 to transition to or maintain the locked state. Similarly, the controller may determine that the trolling motor assembly is in the stowed position and the watercraft 10 is traveling under the threshold speed, and may cause transition of the locking mechanism 130 to the unlocked state. In some embodiments, the locking mechanism 130 may remain in the locked state until receiving a deployment command.

In some embodiments, the locking mechanism 130 may be in electrical communication with the trolling motor mount 113. In some embodiments, the trolling motor mount may be configured with an automatic stow and deploy system. The locking mechanism 130 may be configured to transition to the unlocked position as a part of an automated deployment protocol when the trolling motor mount 113 transitions the trolling motor assembly 100 from the stowed position to the deployed position. Similarly, the locking mechanism 130 may be configured to transition to the locked position as a part of the automated stowage protocol when the trolling motor mount 113 transitions the trolling motor assembly 100 from the deployed position to the stowed position. In some embodiments, the automated deployment protocol may be initiated by the controller.

In some embodiments, the locking system may utilize mechanical connection between the locking mechanism and the connection feature. In such embodiments, the connection feature may be shaped or sized to interact with the locking mechanism to achieve secure attachment therebetween. For example, in some embodiments, the locking mechanism comprises an actuator that is configured to be activated to mechanically move to transition the locking mechanism to the locked state or deactivated to mechanically move to transition the locking mechanism to the unlocked state. In some such embodiments, the locking system may still be configured to automate transitioning the locking system between the locked state and unlocked state, just using a different connection. For example, a linear actuator may be used to extend a component of the locking system to form the locked state (e.g., a portion of the locking mechanism may extend into the connection feature or a portion of the connection feature may extend into a receiving portion of the locking mechanism). Alternatively, the linear actuator may be used to retract a component of the locking system to form the unlocked state.

In some embodiments, one or more components may be biased to transition the locking system to a locked state. For example, the locking system may enter the locked state when the trolling motor assembly enters the stowed position. In such embodiments, for example, the locking system may be configured to automate mechanical opening or working against the bias to transition the locking system to the unlocked state, such as in conjunction with the various functions described herein.

While the above description is focused on a linear actuator for a mechanical connection, other mechanical connection features are contemplated, such as motors, gears, belts, clamps, or the like.

While the above description includes some embodiments where the connection feature is located on the trolling motor assembly and the locking mechanism is attached to the watercraft, in other embodiments, the connection feature may be attached to the watercraft and the locking mechanism may be attached to the trolling motor assembly.

Example System Architecture

FIG. 7 shows a block diagram of an example trolling motor system 300 capable for use with several embodiments of the present invention. As shown, the trolling motor system 300 may include a number of different modules or components, each of which may comprise any device or means embodied in either hardware, software, or a combination of hardware and software configured to perform one or more corresponding functions. For example, the trolling motor system 300 may include a trolling motor head 310, a trolling motor lower unit 315, a housing assembly 320, a stow and deploy system 313, and a locking system 330. In some cases, the trolling motor system 300 may include a foot pedal housing 392.

The trolling motor system 300 may include one or more communications modules configured to communicate with one another in any of a number of different manners including, for example, via a network. In this regard, the communication interface (e.g., 376) may include any of a number of different communication backbones or frameworks including, for example, Ethernet, the NMEA 2000 framework, GPS, cellular, WiFi, or other suitable networks. The network may also support other data sources, including GPS, autopilot, engine data, compass, radar, etc. Numerous other peripheral, remote devices such as one or more wired or wireless multi-function displays may be connected to the trolling motor system 300.

The trolling motor head 310 may include a processor 370, a sonar signal processor 372, a memory 374, a communication interface 376, a user interface 378, a display 380, one or more sensors (e.g., location sensor 382, a position sensor 384, a stowage sensor 383, a motor sensor 388, etc.). Notably, the motor sensor 388 is shown in the trolling motor lower unit 315, although these sensors could be positioned elsewhere (such as in the trolling motor head 310). In some embodiments there may be duplicate sensors positioned in both the trolling motor head 310 and the trolling motor lower unit 315, for example the position sensor 384.

The processor 370 and/or a sonar signal processor 372 may be any means configured to execute various programmed operations or instructions stored in a memory device such as a device or circuitry operating in accordance with software or otherwise embodied in hardware or a combination of hardware and software (e.g., a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 370 as described herein.

In some example embodiments, the processor 370 or sonar signal processor 372 may be configured to receive sonar data indicative of the size, location, shape, etc. of objects detected by the system 300 (e.g., via one or more sonar transducer assemblies 371). For example, the processor 370 may be configured to receive sonar return data and process the sonar return data to generate sonar image data for display to a user (e.g., on display 380 or a remote display).

In some embodiments, the processor 370 may be further configured to implement signal processing or enhancement features to improve the display characteristics or data or images, collect or process additional data, such as time, temperature, GPS information, waypoint designations, or others, or may filter extraneous data to better analyze the collected data. It may further implement notices and alarms, such as those determined or adjusted by a user, to reflect depth, presence of fish, proximity of other watercraft, etc.

The memory 374 may be configured to store instructions, computer program code, marine data, such as sonar data, chart data, location/position data, and other data associated with the sonar system in a non-transitory computer readable medium for use, such as by the processor.

The communication interface 376 may be configured to enable connection to external systems (e.g., an external network 390). In this manner, the processor 370 may retrieve stored data from a remote, external server via the external network 390 in addition to or as an alternative to the onboard memory 374.

The location sensor 382 may be configured to determine the current position and/or location of the trolling motor head 310. For example, the location sensor 382 may comprise a GPS, bottom contour, inertial navigation system, such as micro electro-mechanical sensor (MEMS), a ring laser gyroscope, or the like, or other location detection system.

The display 380 may be configured to display images and may include or otherwise be in communication with a user interface 378 configured to receive input from a user. The display 380 may be, for example, a conventional LCD (liquid crystal display), an LED display, or the like. The display may be integrated into the trolling motor head 310. In some example embodiments, additional displays may also be included, such as a touch screen display, mobile device, or any other suitable display known in the art upon which images may be displayed.

In any of the embodiments, the display 380 may be configured to display an indication of the current direction of the trolling motor lower unit 315 relative to the watercraft. Additionally, the display may be configured to display other relevant trolling motor information including, but not limited to, speed data, motor data battery data, current operating mode, auto pilot, or the like.

The user interface 378 may include, for example, a keyboard, keypad, function keys, mouse, scrolling device, input/output ports, touch screen, or any other mechanism by which a user may interface with the system.

The position sensor 384 may be found in one or more of the trolling motor head 310, the trolling motor lower unit 315, or remotely. In some embodiments, the position sensor 384 may be configured to determine a direction of which the trolling motor lower unit is facing. In some embodiments, the position sensor 384 may be operably coupled to either the shaft or steering system 330, such that the position sensor 384 measures the rotational change in position of the trolling motor lower unit 315 as the trolling motor is turned. The position sensor 384 may be a magnetic sensor, a light sensor, mechanical sensor, or the like.

The stowage sensor 383 may be any type of sensor capable of determining whether the trolling motor assembly has entered the stowed position, transitioned out of the stowed position, and/or entered any other position (e.g., deployed position, intermediate position, etc.). The stowage sensor 383 may be positioned within the trolling motor head 310, trolling motor lower unit 315, the housing assembly 320, the locking system 330, and/or the stow and deploy system 313.

The trolling motor lower unit 310 may include a trolling motor 317, a sonar transducer assembly 371, and one or more other sensors (e.g., motor sensor 388, position sensor 384, water temperature, current, etc.), which may each be controlled through the processor 370 (such as detailed herein).

In some embodiments, the trolling motor system 300 may include a locking system 330, that includes a locking mechanism 331 (e.g., a mechanical locking mechanism, electromagnet, etc.), a connection feature 327, and a power source 333, such as described herein. Additionally, the locking system 330 may include an interruption switch 334. As noted herein, the connection feature 327 may be mounted or positioned on the shaft, the trolling motor head 310, or the housing assembly 320 to engage with the locking mechanism 331 to secure the trolling motor assembly in a stowed position.

In some embodiments, the trolling motor system 300 may include a stow and deploy system 313 that enables usages of, for example, an automated deployment protocol and/or automated stowage protocol. The stow and deploy system 313 may include one or more components that enable trim and/or other movement of the trolling motor assembly (e.g., gears, belts, motors, etc.). In some embodiments, the stow and deploy system 313 may be in communication with the stowage sensor 383 to indicate the positioning of the trolling motor assembly 100.

In some example embodiments, the trolling motor system 300 may further include a foot pedal housing 392 that includes a foot pedal 394, a display 380', and a user interface 378', which may each be connected to the processor 370 (such as detailed herein). In some embodiments, the trolling motor head 310 may not include the display 380 or user interface 378, as it is instead in the foot pedal housing 392 (though some embodiments contemplate inclusion of the display 380 and/or user interface 378 in the trolling motor head).

In some embodiments, the trolling motor system 300 may include additional sensors, for example, a speed sensor, such as an electromagnetic speed sensor, paddle wheel speed sensor, or the like configured to measure the speed of the watercraft through the water.

In some embodiments, the trolling motor system 300 may include a motor sensor. The motor sensor may be a voltage sensor, a rotation per minute (RPM) sensor, a current sensor or other suitable sensor to measure the output of the trolling motor 317.

In some embodiments, the trolling motor system 300 may include a battery sensor. The battery sensor may include a current sensor or voltage sensor configured to measure the current charge of a battery power supply of the trolling motor system 300.

Similarly, FIG. 8 illustrates a block diagram of an example control system 400 capable for use with several embodiments of the present invention. The control system 400 is similar to and includes many of the same components as the trolling motor system 300 shown in FIG. 7. For example, the control system 400 includes a trolling motor assembly 300' with a stow and deploy system 413, trolling motor head 410, housing assembly 420, trolling motor lower unit 415, and foot pedal 494. The control system 400 also includes a locking system 430 that includes a locking mechanism 431, a connection feature 427 (which may be attached to and/or a part of the trolling motor assembly 300'), a power source 433, and an interruption switch 434.

Notably, however, different from the trolling motor assembly 300 of FIG. 7, the control assembly 400 of FIG. 8 includes a remotely-located controller 460 having a processor 470, a memory 474, a communication interface 476, a user interface 478, a display 480, a location sensor 482, a position sensor 484, and a stowage sensor 483. Notably, the controller 460 is located remotely, at least, from the trolling motor assembly 300'. In this regard, in the depicted embodiment of FIG. 8, the trolling motor head 410 may or may not include the functionality depicted in the system of FIG. 7 as some of the functions are contained within the controller 460. However, in some embodiments, both the trolling motor head 410 and the controller 460 may contain similar and/or duplicate sensors, and functionality. In some embodiments, the controller 460 may be a marine electronics device, such as may be present at the helm of the watercraft.

Example Flowchart(s) and Operations

Some embodiments of the present invention provide methods, apparatus, and computer program products related to various embodiments described herein. Various examples of the operations performed in accordance with embodiments of the present invention will now be provided with reference to FIG. 9.

FIG. 9 illustrates a flow chart according to an example method of locking and unlocking the position of a trolling motor assembly according to an example embodiment. The operations illustrated in and described with respect to FIG. 9 may, for example, be performed by, with the assistance of, and/or under the control of one or more of the processor 370, 470, stow and deploy system 313, 413, locking system 330, 430, memory 374, 474, communication interface 376, 476, user interface 378, 478, and/or stowage sensor 383.

The method 500 may include providing a trolling motor assembly at operation 510, such as described herein. The method may continue by providing a locking system to enable securing of the trolling motor assembly to the watercraft at operation 520. The method may continue to by determining if the locking system should be transitioned to an unlocked state or to a locked state at operation 530. In response thereto, the method may include causing transition of the locking system accordingly at operation 540. In some embodiments, at operation 550, the method may include causing changing position of the trolling motor assembly, such as to a deployed position and/or to a stowed position. In some embodiments, operations 530-540 may be performed in different orders and/or simultaneously.

FIG. 9 illustrates a flowchart of a system, method, and computer program product according to an example embodiment. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, memory and executed by, for example, the processor. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A system for locking a trolling motor assembly in a stowed position on a watercraft, the system comprising:

the trolling motor assembly, wherein the trolling motor assembly is attached to the watercraft and movable between the stowed position and a deployed position, the trolling motor assembly comprising:

a shaft extending along a central axis from a first end to a second end; and a trolling motor at least partially contained within a trolling motor lower unit, wherein the trolling motor lower unit is attached to the second end of the shaft, wherein, when the trolling motor assembly is attached to the watercraft and the trolling motor lower unit is submerged in a body of water, the trolling motor, when operating, is configured to propel the watercraft to travel along the body of water;

a locking mechanism mounted to the watercraft and configured to interact with the trolling motor assembly when the trolling motor assembly is in the stowed position, wherein the locking mechanism defines a locked state and an unlocked state, wherein, when the trolling motor is in the stowed position and the locking mechanism is in the locked state, the locking mechanism prevents movement of the trolling motor assembly from the stowed position, and wherein, when the trolling motor is in the stowed position and the locking mechanism is in the unlocked state, the trolling motor assembly is able to move from the stowed position; and a controller comprising:

a processor;

a memory including program code configured to, when executed, cause the processor to:

determine an instance in which to transition the locking mechanism from the locked state to the unlocked state based on at least one of: sensor data, watercraft speed, user input, or any combination thereof; and, in response, cause the locking mechanism to transition from the locked state to the unlocked state.

2. The system of claim 1, wherein the locking mechanism includes an electromagnet configured to be activated to form a magnetic force that, when interacting with the trolling motor assembly, holds the trolling motor assembly in the stowed position to prevent movement of the trolling motor assembly such that the locking mechanism is in the locked state, wherein the electromagnet is further configured to be deactivated to cease forming the magnetic force such that the locking mechanism is in the unlocked state.

3. The system of claim 2, wherein the locking mechanism comprises a connection feature attached to the trolling motor assembly and movable with the trolling motor assembly, wherein, when in the locked state, the electromagnet applies the magnetic force to the connection feature.

4. The system of claim 3, wherein the connection feature of the locking mechanism is attached to the shaft of the trolling motor assembly.

5. The system of claim 2, wherein the magnetic force is applied to the shaft of the trolling motor assembly.

6. The system of claim 1, wherein the locking mechanism comprises an actuator that is configured to be activated to mechanically move to transition the locking mechanism to the locked state or deactivated to mechanically move to transition the locking mechanism to the unlocked state.

7. The system of claim 1, wherein the locking mechanism is biased to the locked state.

8. The system of claim 1, wherein the program code is further configured to, when executed, cause the processor to determine an instance in which to transition the locking mechanism from the unlocked state to the locked state and, in response, cause the locking mechanism to transition from the unlocked state to the locked state.

9. The system of claim 8 further comprising a stowage sensor configured to determine when the trolling motor assembly has entered the stowed position, wherein the program code is further configured to, when executed, cause the processor to determine an instance in which to transition the locking mechanism from the unlocked state to the locked state based on sensor data from the stowage sensor.

10. The system of claim 8, wherein the program code is further configured to, when executed, cause the processor to determine an instance in which to transition the locking mechanism from the unlocked state to the locked state based on a speed of the watercraft being above a threshold speed.

11. The system of claim 10, wherein the threshold speed is 5 miles per hour.

12. The system of claim 1, wherein the program code is further configured to, when executed, cause the processor to determine an instance in which to transition the locking mechanism from the locked state to the unlocked state based on a speed of the watercraft being below a threshold speed.

13. The system of claim 12, wherein the threshold speed is 5 miles per hour.

14. The system of claim 1 further comprising a stow and deploy system for the trolling motor assembly, wherein the stow and deploy system is configured to transition the trolling motor assembly between the stowed position and the deployed position in an automated manner, wherein the program code is further configured to, when executed, cause the processor to determine an instance in which to transition the locking mechanism from the locked state to the unlocked state as part of an automated deployment protocol to transition the trolling motor assembly to the deployed position.

15. The system of claim 14, wherein the program code is further configured to, when executed, cause the processor to determine an instance in which to transition the locking mechanism from the unlocked state to the locked state as part of an automated stowage protocol to transition the trolling motor assembly to the stowed position and, in response, cause the locking mechanism to transition from the unlocked state to the locked state.

16. The system of claim 1, wherein the controller is housed in a housing of the trolling motor assembly.

17. The system of claim 1, wherein the controller is housed in a marine electronics device separate from the trolling motor assembly and the locking mechanism.

18. The system of claim 1, wherein the controller is housed in a housing that is attached to or includes at least a portion of the locking mechanism.

19. A locking mechanism for locking a trolling motor assembly in a stowed position on a watercraft, the locking mechanism comprising:

a base mounted to the watercraft and configured to interact with the trolling motor assembly when the trolling motor assembly is in the stowed position, wherein the locking mechanism defines a locked state and an unlocked state, wherein, when the trolling motor is in the stowed position and the locking mechanism is in the locked state, the locking mechanism prevents movement of the trolling motor assembly from the stowed position, and wherein, when the trolling motor is in the stowed position and the locking mechanism is in the unlocked state, the trolling motor assembly is able to move from the stowed position; and a controller comprising:

a processor;

a memory including program code configured to, when executed, cause the processor to:

determine an instance in which to transition the locking mechanism from the locked state to the unlocked state based on at least one of: sensor data, watercraft speed, user input, or any combination thereof; and, in response, cause the locking mechanism to transition from the locked state to the unlocked state.

20. A method for locking a trolling motor assembly in a stowed position on a watercraft, the method comprising:

providing a trolling motor assembly attached to a watercraft and movable between the stowed position and a deployed position, the trolling motor assembly comprising:

a shaft extending along a central axis from a first end to a second end; and a trolling motor at least partially contained within a trolling motor lower unit, wherein the trolling motor lower unit is attached to the second end of the shaft, wherein, when the trolling motor assembly is attached to the watercraft and the trolling motor lower unit is submerged in a body of water, the trolling motor, when operating, is configured to propel the watercraft to travel along the body of water;

providing a locking mechanism mounted to the watercraft and configured to interact with the trolling motor assembly when the trolling motor assembly is in the stowed position, wherein the locking mechanism defines a locked state and an unlocked state, wherein, when the trolling motor is in the stowed position and the locking mechanism is in the locked state, the locking mechanism prevents movement of the trolling motor assembly from the stowed position, and wherein, when the trolling motor is in the stowed position and the locking mechanism is in the unlocked state, the trolling motor assembly is able to move from the stowed position;

determining, via a controller, an instance in which to transition the locking mechanism from the locked state to the unlocked state based on at least one of: sensor data, watercraft speed, user input, or any combination thereof; and causing, in response thereto, the locking mechanism to transition from the locked state to the unlocked state.

21. A locking mechanism for locking a trolling motor assembly in a stowed position on a watercraft, the locking mechanism comprising:

a base mounted to the watercraft and configured to interact with the trolling motor assembly when the trolling motor assembly is in the stowed position, wherein the locking mechanism defines a locked state and an unlocked state, wherein, when the trolling motor is in the stowed position and the locking mechanism is in the locked state, the locking mechanism prevents movement of the trolling motor assembly from the stowed position, and wherein, when the trolling motor is in the stowed position and the locking mechanism is in the unlocked state, the trolling motor assembly is able to move from the stowed position, wherein the base further includes an electromagnet;

a power source in electrical communication with the electromagnet; and an interference button in electrical communication with the power source configured to interrupt the electrical communication between the power source and the electromagnet.

* * * * *